United States Patent [19]

Plozner

[11] 4,158,215

[45] Jun. 12, 1979

[54] PIEZOELECTRIC SPARK GENERATOR, PARTICULARLY FOR GAS IGNITERS

[75] Inventor: Lisio Plozner, Pordenone, Italy

[73] Assignee: B.P.T. S.p.A., Cinto Caomaggiore, Italy

[21] Appl. No.: 915,100

[22] Filed: Jun. 13, 1978

[30] Foreign Application Priority Data

Jun. 27, 1977 [IT] Italy ..... 53285/77[U]

[51] Int. Cl.[2] ..... F23Q 3/00

[52] U.S. Cl. ..... 361/260; 310/339

[58] Field of Search ..... 361/260; 310/339

[56] References Cited

U.S. PATENT DOCUMENTS

| | | | |
|---|---|---|---|
| 3,469,119 | 9/1969 | Parkinson | 361/260 |
| 3,819,963 | 6/1974 | Kondo et al. | 361/260 |
| 3,976,900 | 8/1976 | Harrison | 310/339 |

FOREIGN PATENT DOCUMENTS

| | | | |
|---|---|---|---|
| 2260067 | 2/1974 | France | 361/260 |

*Primary Examiner*—E. A. Goldberg
*Assistant Examiner*—Clifford C. Shaw
*Attorney, Agent, or Firm*—Sughrue, Rothwell, Mion, Zinn and Macpeak

[57] ABSTRACT

A piezoelectric spark generator comprises a rolling cam of rectangular cross section, the large side of which amounts to 0.08–0.15 times the effective length of the piezoelectric cartridge and in which the angle of inclination of the diagonal exceeds by 3°–6° the angular stroke of the actuating lever. The small longitudinal faces of the cam rest in grooves in the cooperating blocks. The frame is a piece of sheet steel folded to U-shape. The cam protrudes to the outside through opening in the branches of the frame. A portion of the edge of each opening is shaped to provide an end stop for the actuating stroke of the actuating lever.

4 Claims, 6 Drawing Figures

Fig. 4
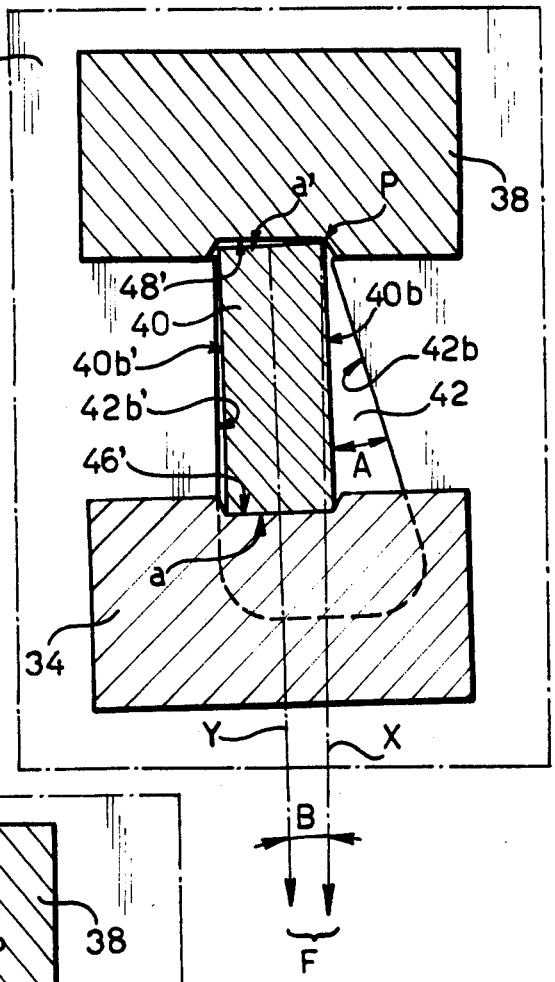
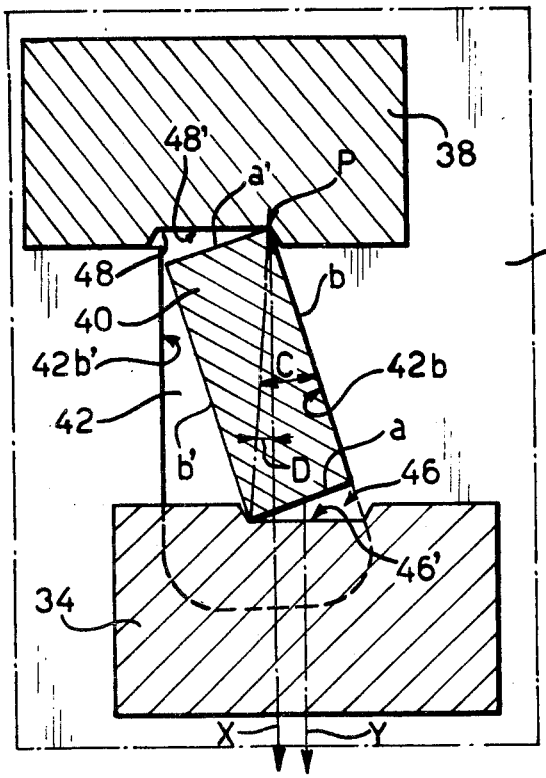
Fig. 5

PIEZOELECTRIC SPARK GENERATOR, PARTICULARLY FOR GAS IGNITERS

U.S. Pat. No. 3,469,119 to David B. Parkinson discloses a piezoelectric spark generator particularly suitable for gas igniters, wherein a rolling cam is suggested as means for applying axial pressure to an end of an elongate piezoelectric cartridge pivotally supported at its opposite end.

A modification of Parkinson generator is disclosed by French Pat. No. 2,260,067 wherein the "rolling cam" consists of a prismatic bar of quadrangular (square-shaped) cross-section. A still further modification is known commercially and comprises: a U-shaped frame pressed of sheet steel, with elongate flat branches parallel to one another; a pressure screw carried by the bottom of the frame; an elongate piezoelectric cartridge, resting with one end against the tip of the screw and extending between the branches of the frame towards the open end of this latter; a fixed reaction block bridging across the branches of the frame in proximity to the said open end; a movable block forming the free end of the cartridge facing towards the fixed block; a rolling cam formed by a bar which passes freely through openings in the two branches and is compressed between the said blocks transversely with respect to its length under the action of the said pressure screw; and an actuating lever including two branches rigidly connected with the respective ends of the said bar projecting from the said openings; and in which moreover the said bar is prismatic, with quadrangular cross-section, disposed to accomplish a rotary movement on its longitudinal edge resting against the fixed block, when the actuating lever is moved.

The generator as just defined above will be indicated in the following as the "generator of the type specified".

The main object of the present invention is the provision of a generator of the type specified of greater effectiveness and convenience of use. In particular, an object of the invention is to make the action of the lever smoother, avoiding excessive harshness in the actuating stroke of the lever and a violent jerk and rebound in the return stroke. Another object is to avoid mis-positioning of the cam, whereby to assure its exact positioning without having recourse to a locating pin or to another purposely added component part. Other objects and advantages will become apparent from the description which follows.

According to the present invention, the piezoelectric generator of the type specified is characterised in that: the said prismatic bar is of rectangular cross-section, the large side of which amounts to 0.08–0.15 times the effective length of the cartridge and in which the angle of inclination of the diagonal to the large sides exceeds by 3°–6° the angular stroke of the actuating lever; the movable block and the fixed block each have a flat-bottomed groove with diverging flanks, in which rests the respective small longitudinal face of the bar, the width of the bottom of the groove being substantially equal to the small side of the said rectangular cross-section so that the bar is prevented from displacement in the groove transversely of this latter; a portion of the edge of each of the openings in the branches of the frame through which the bar passes is shaped in such a way as to constitute for the actuating stroke an end stop acting directly on the pectoral large face of the bar.

Advantageously, the geometric axis of the pressure screw is directed substantially towards the edge of rotation of the bar (rather than towards the geometric axis of this latter) so that, in the rest position, the axis of the cartridge and the axis of the pressure screw form an angle therebetween. At the same time, advantageously, the plane of the bottom of the groove in the movable block is perpendicular to the axis of the cartridge, whilst on the other hand the plane of the bottom of the groove in the fixed block is perpendicular to the axis of the pressure screw. However, if desired, the fixed block may be arranged in an inclined position such that the plane of the bottom of its groove is perpendicular to the axis of the cartridge in the rest position.

A generator according to the invention is illustrated in the appended drawings, in which.

Figure 2:
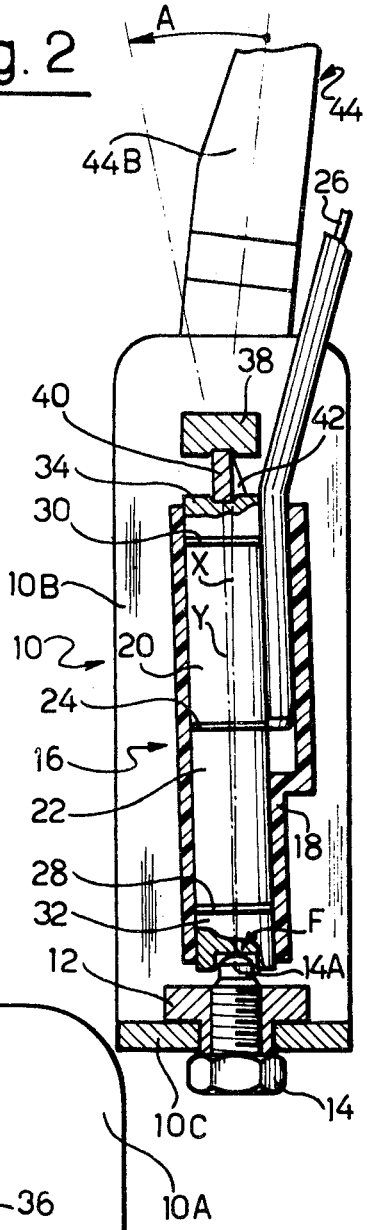
FIG. 2 is a longitudinal cross-section taken on the line II—II of FIG. 1.
Figure 3:
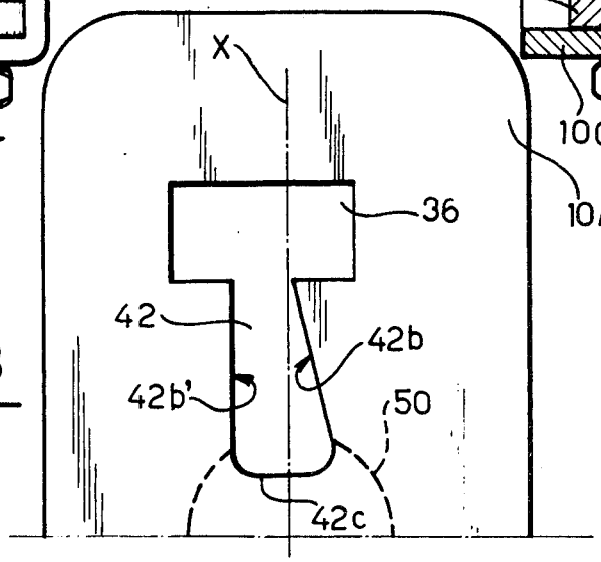
Figure 6:
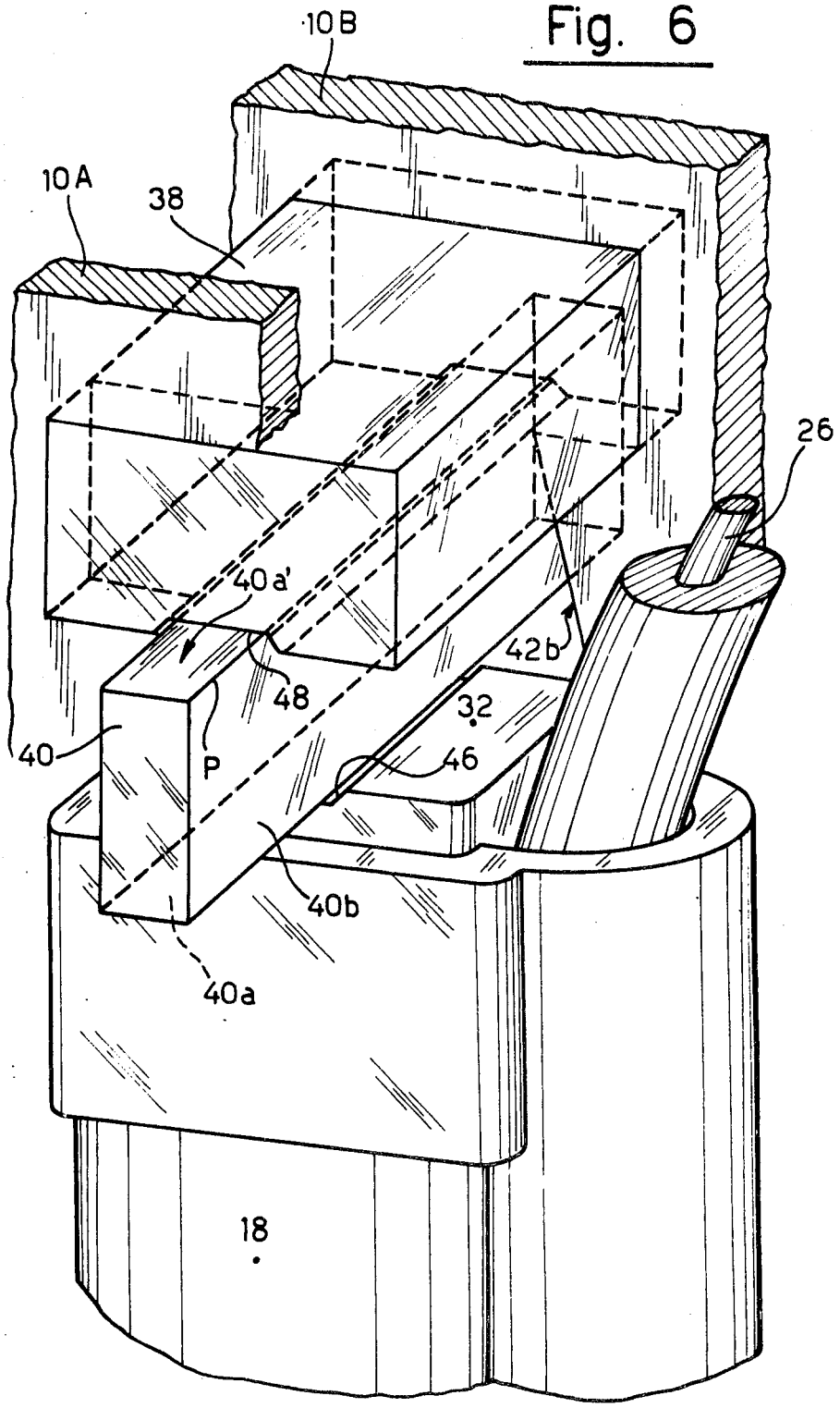

FIG. 3 is a detail view of one of the branches of the frame with the respective opening for accommodation of the fixed block and for the passage of the bar which constitutes the rolling cam, FIG. 4 is a fragmentary view of FIG. 2 on an enlarged scale, FIG. 5 is a view similar to FIG. 4 illustrating the parts at the end of the actuating stroke, and FIG. 6 is a perspective view of the upper end of the piezelectric cartridge with the two blocks, the bar and the adjacent regions of the branches of the frame.

Reference numeral 10 indicates the frame of the generator, pressed from sheet steel and folded into a U-shaped in such a way as to form two flat, parallel, elongate branches 10A, 10B and a bottom wall 10C which closes an end of the frame. In the bottom 10C is set a boss 12 in which can be screwed and unscrewed from the outside a pressure screw 14 with a spherical tip 14A. The geometric axis of the screw 14 is denoted by X. In practice, this axis coincides with the general longitudinal axis of the frame 10.

Against the tip 14A rests axially an elongate piezoelectric cartridge, generally denoted by 16. The cartridge includes, in a known way, a tubular sheath 18 of insulating plastics material enclosing two axially aligned small cylinders 20, 22 of peizoelectric material connected electrically in parallel. That is to say, between the electrically identical inner ends of the cylinders is interposed an electrode plate 24, from which extends the "hot" wire 26. Other electrode plates 28, 30 are applied each against the outer end of each cylinder 20, 22 for grounding them. Against the lower plate 28 is applied a cylindrical pad 32 of hard steel (or of a hard sintered metal) having in a known way on its outer end face a recess in which is centred the tip 14A of the pressure screw 14. The point of contact F of the pad 32 against the tip 14A constitutes, in a known way, the fulcrum of oscillation of the cartridge 16 in the frame 10. Against the electrode plate 30 is applied, in the sheath 18, a block 34 of hard metal, for example of steel. All these components are aligned on the axis Y, which is the geometric axis of the cartridge 16 and, obviously, passes through the fulcrum F.

Figure 1:
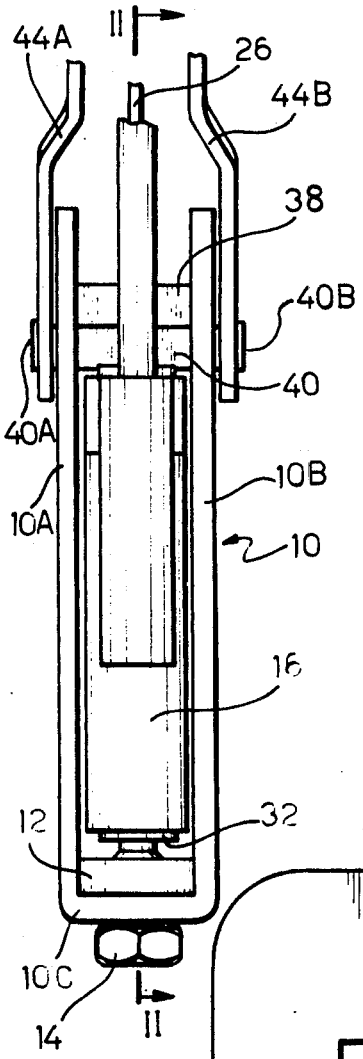
FIG. 1 is an elevational view.

In proximity to the open end of the frame each of the branches 10A, 10B, has a rectangular opening, such as that indicated 36 in the branch 10A, in FIG. 3, and these openings are exactly aligned with one another in the direction perpendicular to the axis X and to the branches. Reference numeral 38 indicates a rectangular, prismatic block of hard steel, the ends of which are secured (for example by punching), in the openings 36 so that the block 38 forms a bridge connecting the two branches 10A, 10B; the axis X intersects this bridge, as can be seen in FIGS. 2–5. The block 38 is fixed, whilst on the other hand the block 34 is movable together with the cartridge 16. In the rest position (FIG. 4) the two blocks are facing one another and compress between them the "rolling cam" constituted by a quadrangular prismatic bar 40 of hard steel, advantageously obtained by drawing. The bar 40 passes freely through openings 42 cut in the branches of the frame, and its end 40A, 40B (FIG. 1) project from the frame towards the outside to permit actuation of the cam by an actuating lever 44. The lever 44 includes two comparison branches 44A, 44B rigidly connected together, which embrace between them the open end of the frame 10 and in which are rigidly secured (for example by punching) the respective ends 40A, 40B of the bar 40. The pressure clamping the bar 40 between the blocks 34, 38 is adjustably produced by the screw 14.

According to the invention, each of the two blocks 34, 38 has, to receive the bar 40, a groove 46, 48 respectively with a flat bottom 46, 48 respectively and with diverging flanks. The longitudinal mid-line of the groove 46 in the movable block 34 intersects perpendicularly with the axis Y of the cartridge and is perpendicular to the two branches of the frame. The distance between the bottom 46' of this groove and the fulcrum F of the cartridge constitutes, as far as the present description is concerned, the "effective length" of the cartridge 16. The plane in which the bottom 46' lies is perpendicular to the axis Y.

Still according to the invention, the bar 40 is of rectangular cross-section, the small sides of which are indicated in FIG. 5 with a and a' and the large sides with b and b'. These latter each have a length which amounts to 0.08 up to 0.15 times the said "effective length" of the cartridge. Moreover, indicating with A FIGS. 2 and 4) angular stroke of the actuating lever 44, the mutual ratio of the sides of the said rectangular section of the bar 40 is chosen in such a way that the angle of inclination C of the diagonals exceeds by 3°–6° the angle A. Moreover, as can be seen in FIGS. 4 and 5, the transverse width of the bottoms 46', 48' of the grooves is practically equal to the length of the smaller sides a, a', that is to say to the width of the corresponding faces **40*a*, 40*a'* of the bar 40, whereby the position of the bar with respect to the blocks 34, 38** is perfectly determined, and whereby the flanks of the grooves prevent accidental translational movements of the bar transversely of the grooves.

Preferably, the fixed block 38 is not centred on the axis X of the pressure screw, but rather is decentred in such a way that the axis X is directed at least approximately towards the edge of rotation P (FIGS. 4–5) of the bar 40. With this arrangement, in the rest position (FIG. 4) the axis Y of the cartridge does not coincide with the axis X, but forms with this latter a small angle B the tangent of which is determined very closely by the ratio of one half of the small side a (or a') to the effective length of the cartridge. In practice, the recommended value of B is 1°–2°. In this way the smoothness of operation of the generator is still further increased.

It will be observed that, in the rest conditions (FIG. 4), the bar 40 completely rests with its lower small face **40*a* (FIG. 6) on the bottom 46' of the groove 46 and thus takes the position of stable equilibrium with respect to the pressing force of the screw 14 acting along the axis X. The fixed block 38 could therefore be positioned in such a way that, again in the rest conditions, the bottom 48' of the groove 48 in the said block would be parallel to the above mentioned bottom 46', that is to say in such a way that also the upper small face 40*a'* of the bar would match exactly with the bottom 48'. This however is not strictly necessary. Rather, it is preferable in practice that the plane of the bottom 48' of the groove 48 in the fixed block 38 be perpendicular to the axis X of the pressure screw, and that, on the other hand, the bottom 46' of the groove 46 in the movable block 34 be perpendicular to the axis Y of the cartridge. With this arrangement, in the first place, the positioning of the individual pieces during their working (punching of the openings 36 and pressing of the grooves 46', 48') are substantially simplified. Moreover, in this way, the contact pressure between the bar 40 and the fixed block 38** is localised on the edge of rotation P of the bar, thus contributing to the constancy of position of this edge on the fixed block during the entire life of the generator.

In each case, a portion of he contour edge of the openings 42 for the passage of the bar 40 through the branches 10A, 10B of the frame 10 is formed in such a way as to constitute for the actuating stroke an end stop acting directly on the pectoral large face of the bar. The term "pectoral large face" is intended to distinguish that large face (**40*b*) of the bar which performs an angular forward movement when the lever 44 performs its actuating angular stroke A; the opposite large face (40*b'*) will here be called the "dorsal large face". In the specific case illustrated, the edge which delimits the opening 42 comprises, facing the pectoral face 40*b*, a rectilinear portion 42*b* pointing toward the edge of rotation P of the bar 40 and which, in the rest position of the generator, forms with the said pectoral face an angle equal to the angle A. At the end of the actuating stroke (FIG. 5) the pectoral face of the bar stops against the said rectilinear portion 42*b*, and so the lever 44 cannot accomplish a stroke greater than A. In these conditions, thanks to the previously stated relation between the angles C and A, the diagonal of the bar passing through the edge of rotation P forms with the axis X an angle D of 3°–6°, preferably around 4°, necessary for the conservation of a return couple urging the bar (and therefore the lever 44) back to the rest position. As been already said, in the rest position the bar 40 is in stable equilibrium. Consequently, at least theoretically, purpose added means for stopping the bar (and therefore the lever 44) in such position are not necessary. It is advisable however, for this purpose of stopping, to take advantage of another edge portion of each of the openings 42, at least to provide a safety stop. In the specific case, the opening 42 has a rectilinear edge portion 42*b'* opposite the portion 42*b*, which in the rest position of the bar 40 is immediately adjacent the dorsal large face 40*b'* of the bar (FIG. 4). The portion 42*b'* could be exactly parallel to the said face 40*b'* (considered in the rest position); in practice, however, in order to avoid unnecessary manufacturing complications, it is sufficient that the edge portion 42*b'* be merely parallel to the axis X and perpendicular to the fixed block 38, in such a way that the dorsal face 40*b'* of the bar can eventually rebound slightly against the said portion 42*b'*** in order to then reassume the position of stable equilibrium first mentioned.

The two edge portions **42*b*, 42*b'* can merge into each other by a transverse portion 42*c* (FIG. 3). If required, however, they can be expanded downwardly, to form an eyelet 50 extending along the respective branch 10A, 10B of the frame, ending substantially in proximity to the bottom 10C**, in accordance with the calculated strength of the frame.

For a gas igniter in which the lever 44 ends in a push button operated by the thumb of a hand, the generator described above can be proportioned as follows.

It may be assumed that, for operation by hand, the angular stroke A of the lever amounts preferably to 15°–20°; one selects for example, A=18°. Thus the inclination of the diagonal should be C=21°–24°; one selects for example C=22°. Supposing that the effective length of the cartridge 16 is 40 mm, b can assume a value of 4.5 mm; then results a=1.8 mm. For the bar 40 can be used therefore a piece of drawn steel of cross-section 4.5×1.8 mm. Each of the grooves 46, 48 will have a width at the bottom of 1.8–1.9 mm. For the inclination of the flanks of the grooves will be chosen, obviously, an angle (with respect to the perpendicular to the bottom) of a little more than A, for example 25°–30°. It is sufficient for the depth of the grooves to be only a few tenths of a millimeter, for example 0.3–0.4 mm. The fixed block will have to be decentred with respect to the axis X by a/2, that is to say by 0.9 mm, with the result that in the completed generator the angle B of convergence of the axes X and Y in the rest conditions will amount to about 1°15'. The angle D which produces the return couple is C−A×4°.

What I claim is:

1. In a piezoelectric spark generator comprising: a U-shaped frame pressed of sheet steel, with elongate flat branches parallel to one another; a pressure screw carried by the bottom of the frame; an elongate piezoelectric cartridge, resting with one end against the tip of the screw and extending between the branches of the frame towards the open end of this latter; a fixed reaction block bridging across the branches of the frame in proximity to the said open end; a movable block forming the free end of the cartridge facing towards the fixed block; a rolling cam formed by a bar which passes freely through openings in the two branches and is compressed between the said blocks transversely with respect to its length under the action of the said pressure screw; and an actuating lever including two branches rigidly connected with the respective ends of the said bar projecting from the said openings; and in which moreover the said bar is prismatic, with quadrangular cross-section, arranged to perform an angular movement on one its longitudinal edge resting against the fixed block on actuation of the lever, the improvements comprising:

the said prismatic bar of rectangular cross-section, the large side of which amounts to 0.08–0.15 times the effective length of the cartridge and in which the angle of inclination of the diagonal to the large sides exceeds by 3°–6° the angular stroke of the actuating lever; the movable block and the fixed block have each a flat-bottomed groove with diverging flanks in which rests the respective small longitudinal face of the bar, the width of the bottom of the groove being substantially equal to the small side of the said rectangular cross-section whereby the bar is prevented from displacement in the groove transversely of the latter; a portion of the edge of each of the openings in the branches of the frame through which the bar passes is shaped to constitute at the actuating stroke an end stop acting directly on the pectoral large face of the bar.

2. A generator according to claim 1, in which the geometric axis of the pressure screw is directed substantially towards the edge of rotation of the bar whereby the axis of the pressure screw and the axis of the cartridge in rest position form an angle therebetween.

3. A generator according to claim 1, in which the plane of the bottom of the groove in the movable block is perpendicular to the axis of the cartridge, whilst the plane of the bottom of the groove in the fixed block is perpendicular to the axis of the pressure screw.

4. A generator according to claim 1, in which a further edge portion of each opening is formed to constitute a stop for the dorsal large face of the bar at the return stroke of the lever.

* * * * *